US008641435B2

(12) United States Patent
Bromell

(10) Patent No.: US 8,641,435 B2
(45) Date of Patent: Feb. 4, 2014

(54) TOY CAR USB MEMORY STORAGE DEVICE

(76) Inventor: Poiette Bromell, Marion, SC (US)

( * ) Notice: Subject to any disclaimer, the term of this patent is extended or adjusted under 35 U.S.C. 154(b) by 7 days.

(21) Appl. No.: 13/234,973

(22) Filed: Sep. 16, 2011

(65) Prior Publication Data

US 2013/0005177 A1 Jan. 3, 2013

Related U.S. Application Data

(60) Provisional application No. 61/383,391, filed on Sep. 16, 2010.

(51) Int. Cl.
*H01R 3/00* (2006.01)

(52) U.S. Cl.
USPC ..... 439/188

(58) Field of Classification Search
USPC ..... 439/488, 135, 353, 358, 660; 361/679.32, 752, 737
See application file for complete search history.

(56) References Cited

U.S. PATENT DOCUMENTS

| | | | | |
|---|---|---|---|---|
| 7,341,464 | B2 * | 3/2008 | Cuellar et al. | 439/135 |
| 7,503,780 | B1 * | 3/2009 | Huang | 439/135 |
| 7,547,218 | B2 * | 6/2009 | Hiew et al. | 439/135 |
| 2006/0038023 | A1 * | 2/2006 | Brewer et al. | 235/492 |
| 2006/0218119 | A1 | 9/2006 | Pomerantz | |
| 2009/0190298 | A1 * | 7/2009 | Panas | 361/679.32 |
| 2010/0131683 | A1 * | 5/2010 | Moore et al. | 710/63 |

* cited by examiner

*Primary Examiner* — Jean F Duverne

(74) *Attorney, Agent, or Firm* — Daniel Boudwin; Global Intellectual Property Agency LLC

(57) ABSTRACT

A Universal Serial Bus (USB) memory device capable of being concealed within a housing exterior designed to resemble a toy car. The device has a USB connector, which can slide out of the rear end of the toy car and be inserted into a USB port on a computer to establish a communication link between the computer and the device. The headlights of the toy car will blink, when a connection is established Alternatively, the tires may spin and the sound of a revving car engine will be emitted from the device when the connection is established. The housing is capable of concealing the USB connector inside of the toy car exterior, making the device completely unrecognizable as a USB memory device. Concealment of the device is intended to discourage theft of the USB memory device and the sensitive information contained thereon.

6 Claims, 3 Drawing Sheets

TOY CAR USB MEMORY STORAGE DEVICE

CROSS REFERENCE TO RELATED APPLICATION

This application claims the benefit of U.S. Provisional Application No. 61/383,391 filed on Sep. 16, 2010, entitled "Flashy Flash Drive."

BACKGROUND OF THE INVENTION

1. Field of the Invention

The present invention relates to portable USB flash memory devices. More specifically, the present invention is a USB memory device contained within the body of a toy car. The device features a retractable USB connector for concealing the USB connector from view, making the device unrecognizable as a USB memory device, as the device should be mistaken for a toy car.

2. Description of the Prior Art

USB flash memory devices have changed the way individuals store information. Older forms of memory storage devices, such as the floppy disks, 3.5-inch diskettes and writable compact disks, have been rendered nearly obsolete technology because of the steady-state technology of flash memory. These old forms of memory storage were physically bulky and could only hold relatively small amounts of digital information. Flash memory is a form of storage memory that can be electrically erased and rewritten, is cheaper, smaller and more efficient than previous forms of data storage. Not only is flash memory used in many technology applications such as digital cameras, mobile phones and medical electronics, it is also used by individuals to store computer data. A USB memory device is a data storage device that has an integrated USB interface such that the device can be connected to a USB port on a computer or similar digital device. A USB memory device is typically pocket-sized and often holds upwards of several gigabytes (GB) of data storage space. USB flash memory devices are known by many names, including jump drives, memory sticks, flash drives and USB jump drives.

The only problem associated with USB storage devices is how easily identifiable they are. USB memory devices typically look the same and are easily recognizable as USB memory devices. Unfortunately, because they are easily identifiable, small and portable, USB memory devices can easily be stolen. Sometimes individuals prefer storing sensitive information on USB memory devices because information can be transferred from one computer to another without having to access the internet, which avoids the risk of the information being intercepted by hackers who are attempting to steal the information during its transmission through cyberspace. When information is stored on a USB memory device, the information can be physically handed from one individual to another, without the risk of someone else intercepting the information stored on the device. Yet, theft of such a small device is easy, and of particular concern with regards to the volume of information modern USB storage devices can retain.

Several patent applications have published regarding devices that attempt to describe portable USB covers, yet they do not describe a USB memory device that is completely disguisable as a toy car. For example, U.S. Patent Application Publication No. 2009/0190298 to Panas describes a decorative ornamental cover, designed to resemble a novelty item, for a USB memory device. One of the embodiments of the Panas device is a decorative toy automobile cover for a USB memory device. The device looks like a small car with a USB connector located at the rear of the toy car. It is apparent from the protruding USB connector that the device is a USB memory device, enabling an individual to easily recognize the device as such. Knowing that the device is a USB memory device with a toy car cover, a thief with the motivation and desire could easily identify the device and steal it, along with the sensitive information contained therewith.

The present invention is designed to be completely unrecognizable as a USB memory device when not plugged into a computer. The USB connector on the present invention is retractable. When the device is not in use in a computer, a user may retract the USB connector into the body of the device, making the device indistinguishable from an ordinary toy car. Without prior knowledge that the USB flash memory device is concealed within the body of the toy car, a thief would not be able to identify the USB memory device as a USB memory device and, therefore, would fail at stealing the device and any sensitive information contained within the device. The device further provides feedback to the user when engaged with a USB port, wherein the device's lights flash, and alternatively the wheels may spin and a revving sound may be provided.

A second patent application for USB covers exists as U.S. Patent Application Publication No. 2006/0218119 to Pomerantz. The Pomerantz patent application describes a cover for electronic devices that is designed to assist users in remembering his or her electronic device after use. One embodiment of the device is a USB memory device cover to aid a user in remembering to collect his or her USB device after using it in a computer that is not his or her own. The patent application gives the example of a common occurrence where a speaker, or lecturer, fails to remove his USB drive from the podium computer after he or she is finished giving a presentation. When the device is detached from the device cover, the cover expands in at least one dimension, and exists in an inconvenient form that is not easily overlooked by the user, thus serving as a reminder that the user must collect his or her device. However, when the device and the device cover are joined, the cover collapses making the device compact enough to easily fit in a user's pocket.

The Pomerantz device is not designed to conceal the electronic device or USB memory device, but rather is designed to be a reminder to the user not to forget, or leave behind, his or her electronic device. In the case of the electronic device being a USB memory device, the USB device is still easily identifiable as a USB memory device, because the USB connector is visible, and the device covering is not designed to disguise the device. If a thief were so inclined, he or she could easily identify the Pomerantz device as a USB memory device and could steal it. The present invention aims at completely disguising a USB memory device so that it cannot be recognized as such. By encasing the USB memory device inside of a toy car exterior housing, and providing a means by which the USB connector on the device can be retracted into the body of the toy car, a user could fully conceal the USB memory device, leaving the device as only recognizable as a toy car. A thief would have to know that he or she is explicitly searching for a toy car USB device in order to succeed in stealing the device.

The present invention substantially diverges in design elements from the prior art and consequently it is clear that there is a need in the art for an improvement to existing USB memory device concealing devices and means. In this regard the instant invention substantially fulfills these needs.

SUMMARY OF THE INVENTION

In view of the foregoing disadvantages inherent in the known types of USB memory device covers now present in the prior art, the present invention provides a new USB memory device with a covering that resembles a toy car wherein the same toy car exterior can be utilized for providing complete concealment of the USB memory storage device, including facilitating the concealment of the USB connector.

It is therefore an object of the present invention to provide a new and improved USB flash memory storage device which is completely disguisable as a toy car and has all of the advantages of the prior art and none of the disadvantages.

Another object of the present invention to provide a cheap and efficient means for completely disguising a USB flash memory device.

Another object of the present invention is to provide a means of preventing the theft of sensitive information stored on USB memory devices.

Another object of the present invention is to provide a housing for a USB drive that functions to enclose the retracted USB connection and provides a automobile likeness with blinking or otherwise illuminating headlights, as well as optional spinning wheels and automobile noises for specific events.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
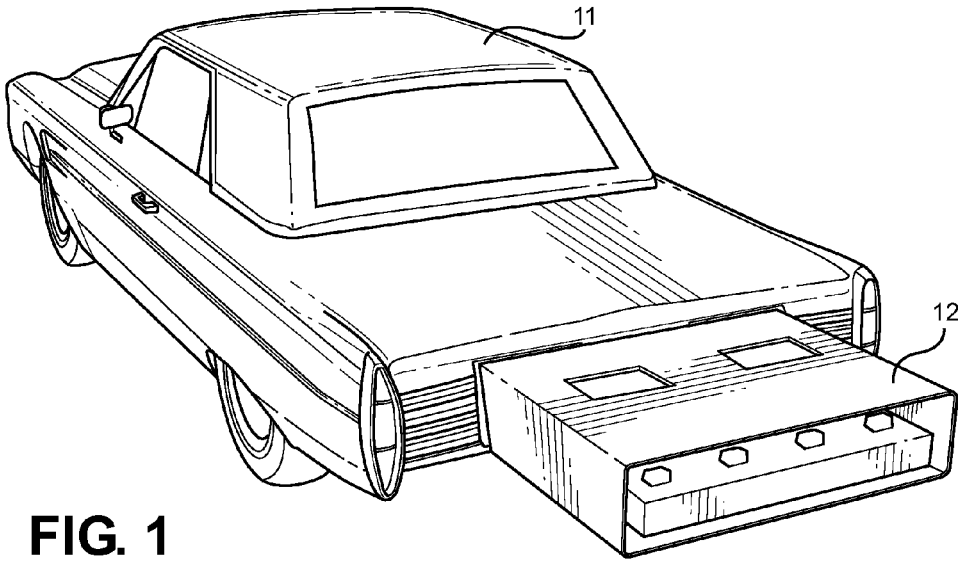
FIG. 1 is a perspective view of the present invention from the USB connector end of the device, wherein a vintage car housing is provided.

Referring now to FIG. 1, there is shown a perspective view of the present invention from the USB connector end of the device. The USB flash memory is located inside of an exterior housing 11 that is shaped like a toy car. In this embodiment, the toy car housing is a vintage car with headlights and wheels. The USB connector 12 is located at the rear end of the housing 11. Only a visual inspection of the USB connector 12 when it is protruding out of the rear end of the toy car housing exterior 11 would suggest that the device is a USB flash memory device and not only a toy car. To use the device, a user would plug the USB connector end of the device into a computer USB port to allow the USB memory device to establish a communication link between the device and the computer. A user could store data to the USB memory device, or could transfer data from the USB memory device to his or her computer. In one embodiment of the device, when connection is established or when the USB drive is being accessed, the headlights of the housing light up, simulating real car headlights.

Figure 2:
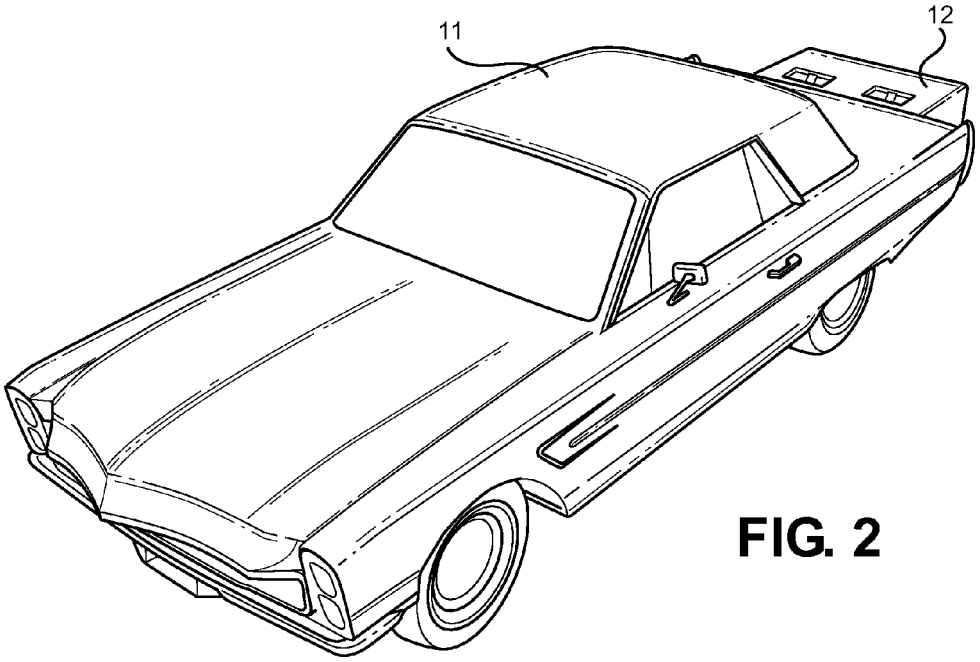
FIG. 2 is a perspective view of the present invention from the non-USB end of the device, wherein a vintage car housing is provided.
Figure 3:
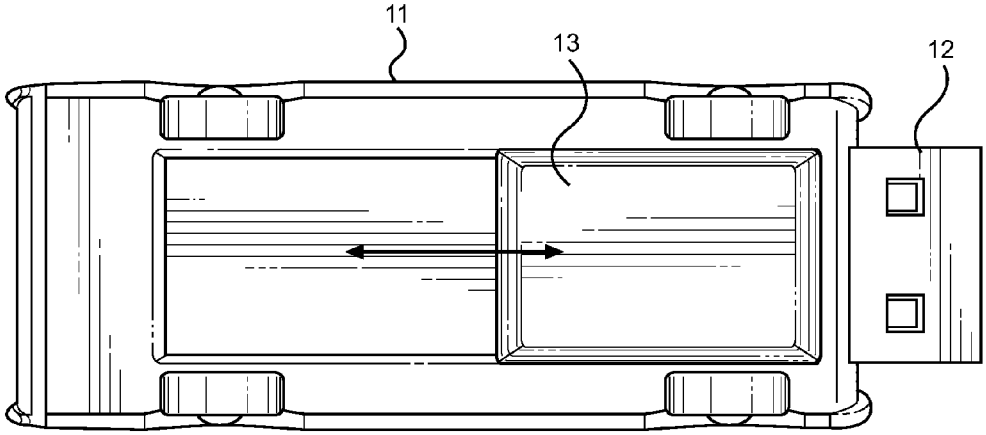
FIG. 3 is an underside view of the device, wherein the sliding mechanism for the USB connection is shown along the underbelly of the vintage car housing.

Referring now to FIG. 2, there is shown a perspective view of the present invention, from an end opposite of the USB connector end of the device. This end of the device is also the front end of the toy car exterior, which provides view of the car headlights and the features of the particular make or model toy car. In the embodiment shown, a vintage car is shown as the housing 11. The toy car is not only a shell of a toy car, the toy car also features a pair of headlights which blink when the device is connected to or access by a computer. The housing 11 internal cavity provides space to house all electronics necessary to operate the USB drive, provide a cavity for retracting the USB connector and all electronics for operating the embodiments of the housing ornamental features. These features may include blinking or illuminated headlights, a revving noise from a small, imbedded speaker or spinning of the tires.

Figure 4:
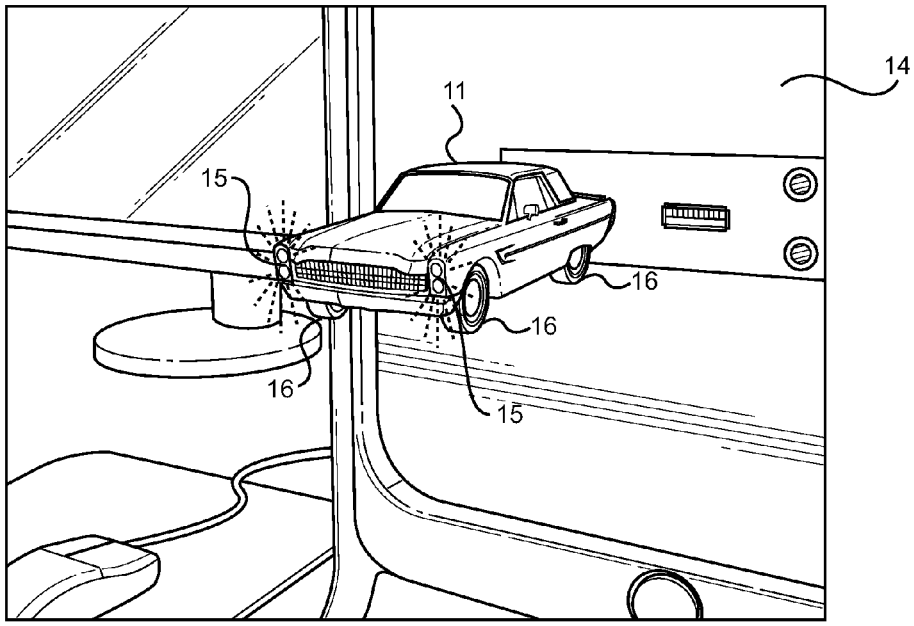
FIG. 4 is a perspective view of the present invention, wherein a vintage car housing is provided and the device is being utilized in conjunction with a USB port on a desktop computer.

The USB connector 12 of the device is capable of being retracted into the toy car housing 11. Referring now to FIG. 4, located on the underside of the toy car housing 11 is a sliding mechanism 13 that controls the state of the USB connector 12. The sliding mechanism 13 is capable of achieving two positions regarding the USB connector: a protruding position of the USB connector, as shown, and a retracted position of the USB connector. When the USB connector 12 is in the protruding position, the USB connector 12 protrudes from the rear of the toy car housing 11, and the device is recognizable as a USB memory device. In this position, the device can be used for transmitting data to and from the device by plugging the USB memory device into a computer via a USB port. When the sliding mechanism is in the retracted position, the USB connector is no longer visible and the device is unrecognizable as a USB memory device without detailed inspection. Instead, the device is completely disguised as a toy car. An individual who observes the device when the sliding mechanism, and thus USB connector, are in the retracted position, would only see a toy car and not a USB memory device.

Referring now to FIG. 4, there is shown a perspective view of the present invention connected to a desktop computer via a USB port. To indicate the connectivity of the USB flash memory device to the computer 14, when the USB memory device is plugged into a USB port, a light emitting diode (LED)—located in a position where the headlights 15 are placed on the toy car housing—will blink, serving as an indicator that the USB memory device has established a connection with the computer or is being accessed. In alternate embodiments of the housing and overall device features, when the present invention has established a communication link or is being accessed by the computer the tires 16 of the toy car will spin to simulate the car driving. A small wheel-spinning means is provided within the interior of the housing to affect the wheel spin, wherein an axle of one or two wheel sets may be turned by a rotary mechanism and electric motor. The toy car may further feature a small speaker that emits a sound of an engine revving as the USB device establishes a link or is accessed. These two embodiments may further be combined to offer a toy car USB device with spinning tires and engine noise during such events.

Figure 5:
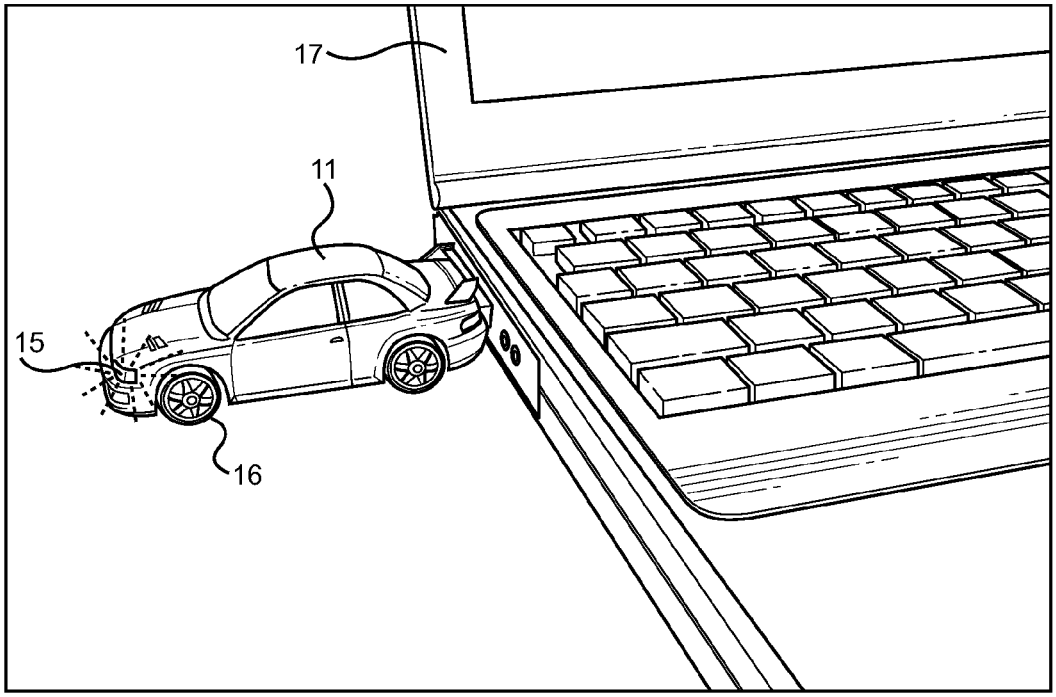
FIG. 5 is a perspective view of the present invention, wherein a modern car housing is provided and the device is being utilized in conjunction with a USB port on a laptop computer.

Referring now to FIG. 5, there is shown a perspective view of the present invention when the USB connector is connected to a laptop computer via a USB port. The housing of this embodiment includes a modern car styling, as opposed to a vintage car. The only requirements of the housing are that the interior volume provides sufficient space for the USB and toy electronics, and that it resembles a car or vehicle. It is not desired to limit the style of the housing or the embodiments of the lighting, engine sound or tire spinning to a particular configuration.

To this point, the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A USB memory device concealed within a toy car housing, comprising:

a USB memory device for storing digital data, said USB memory device having a USB connector for connecting to a USB port;

a toy car housing having a front end, a rear end, headlights locatable at said front end and rotatable tires electrically connected to said USB memory device, wherein said toy car is adapted to resemble a four-wheeled automobile, said housing having an interior volume adapted to fit said USB member device, USB connector and associated electronics therein;

a retraction means for retracting said USB connector into said housing interior;

a lighting indicator electrically connected to said USB memory device and projected through said housing headlights;

wherein said USB memory device indicates an active connection between said USB memory device and a USB port of an electronic device, or access of data stored on said USB memory device by said electronic device by initiating spinning of said tires and illuminating said lighting indicator.

2. The device of claim 1, wherein said USB connector being capable of retracted into said toy car housing interior by a retraction means for the purpose of completely concealing the USB connector.

3. The device of claim 2, wherein said retraction means is a sliding mechanism located on said housing bottom side.

4. The device of claim 3, wherein said sliding mechanism is capable of achieving two positions with regard to said USB connector: a protruding position for enabling said connector to be plugged into a USB port, and a retracted position wherein said connector is concealed within said housing interior.

5. The device of claim 1, wherein said USB memory device further indicates said active connection by flashing said headlights of said toy car housing.

6. The device of claim 1, further comprising a speaker, wherein said USB memory device further indicates said active connection by emitting a sound of a car engine reviving from said speaker.

* * * * *